United States Patent [19]

Matthews et al.

[11] 4,313,969

[45] Feb. 2, 1982

[54] METHOD AND APPARATUS FOR PROVIDING LOW GLOSS AND GLOSS CONTROLLED RADIATION-CURED COATINGS

[75] Inventors: John C. Matthews, Columbia; Robert W. Couch, Frederick, both of Md.

[73] Assignee: Fusion Systems Corporation, Rockville, Md.

[21] Appl. No.: 73,630

[22] Filed: Sep. 10, 1979

[51] Int. Cl.[3] ..... B05D 3/06

[52] U.S. Cl. ..... 427/44; 204/159.11; 204/159.14; 204/159.22; 427/53.1; 427/54.1

[58] Field of Search ..... 427/44, 53.1, 54.1; 204/159.11, 159.14, 159.22

[56] References Cited

U.S. PATENT DOCUMENTS

| | | | |
|---|---|---|---|
| 3,759,808 | 9/1973 | Parker et al. | 427/54.1 |
| 3,783,004 | 1/1974 | Parker | 427/54.1 |
| 3,918,393 | 11/1975 | Hahn | 427/54.1 |
| 3,943,046 | 3/1976 | De Sorea et al. | 427/54.1 |
| 3,948,839 | 4/1976 | De Vries | 260/29.4 R |
| 3,953,622 | 4/1976 | Wismer et al. | 427/54.1 |
| 3,966,572 | 6/1976 | Carder | 427/54.1 |
| 3,992,275 | 11/1976 | Shahidi et al. | 427/54.1 |
| 4,020,193 | 4/1977 | Wismer et al. | 427/54.1 |
| 4,029,831 | 6/1977 | Daunheimer | 427/54.1 |
| 4,048,036 | 9/1977 | Prucnal | 427/54.1 |
| 4,073,975 | 2/1978 | Buckwalter et al. | 427/170 |
| 4,075,366 | 2/1978 | Packer et al. | 427/44 |
| 4,113,894 | 9/1978 | Koch | 427/54.1 |
| 4,165,265 | 8/1979 | Nakabayashi et al. | 427/54.1 |
| 4,169,167 | 9/1979 | McDowell | 427/54.1 |
| 4,170,663 | 10/1979 | Hahn et al. | 427/44 |

*Primary Examiner*—John H. Newsome

*Attorney, Agent, or Firm*—Pollock, Vande Sande & Priddy

[57] ABSTRACT

A method and apparatus for providing low gloss and controlled gloss radiation cured coatings, and for effecting on-line control of the degree of gloss provided. A radiation-curable coating of a composition which includes inert particulates is first irradiated with curing radiation of wavelengths to which the coating is responsive but having substantially no distribution beneath about 300 nm, and is subsequently irradiated with curing radiation of wavelengths to which the coating is responsive including substantial radiation at wavelengths beneath 300 nm. Gloss control is obtained by adjusting the spectral distribution, the intensity, or the dose of the initial radiation, or by adjusting the time interval between the initial and subsequent irradiation steps.

21 Claims, 3 Drawing Figures

METHOD AND APPARATUS FOR PROVIDING LOW GLOSS AND GLOSS CONTROLLED RADIATION-CURED COATINGS

The present invention is directed to a method and apparatus for producing low gloss and controlled gloss radiation-cured coatings, and to a method and apparatus for effecting on-line control of the degree of gloss provided.

In recent years radiation-polymerizable compositions have found widespread usage as coatings for a great variety of commercial products. While such coatings have many desirable properties, they are not inherently suited for all applications.

Thus, if processed conventionally most radiation-cured coatings result in a normally glossy finish. While satisfactory for some applications, for a great many other applications coatings having a low gloss or matte finish are preferred. For example, if a decorative pattern of a natural substance such as wood, slate, or brick is coated, a high gloss coating will look shiny and artifical whereas a low gloss coating will allow the natural finish to project through. And with other items including certain types of flooring, a low gloss finish is desired for its superior wear characteristics as well as for its preferred appearance.

While low gloss coatings are frequently desired, the gloss level of a product for any given application can be either too high or too low. It is thus not only desirable to provide a process which produces low gloss coatings but one which is also capable of being adjusted to precisely control the degree of gloss which is attained by the cured coating. A further requirement is that the gloss control technique be capable of being employed "on-line", so that the flow of material on the process line is not interrupted.

The prior art approach to obtaining low gloss coatings has been primarily to utilize coating compositions which include flatting agents. Such agents are specific types of chemicals which tend to give the coating a "flatter" appearance than when the agents are not present.

A problem with this approach has been that the degree of gloss reduction obtained has usually been limited, particularly with thick films, and may not be sufficient for all applications. Of equal significance is that fact that using only the makeup of the chemical composition to control gloss precludes the use of an on-line control technique. Thus, each time it is desired to change the gloss level, a new coating composition from a new reservoir must be introduced to the process line, which may entail interruption or disturbance of the line.

Further, it has been found that different batches of what is nominally the same coating composition may in fact differ significantly in chemical composition, thus resulting in supposedly identically cured products which actually have different gloss levels. Also, variations in the overall process itself such as differences in the coating thickness applied are usual, and these too can affect the degree of gloss obtained. It would be desirable to have an on-line gloss control process which can be adjusted to compensate for unpredictable variations in such materials or processes to produce products having uniform gloss.

A further prior art approach to gloss reduction is a process in which an oxygen-inhibited coating is first exposed to curing radiation in an oxygen containing atmosphere and is then subjected to radiation in an inert, relatively oxygen-free atmosphere. While this procedure is effective to reduce gloss it is somewhat limited and inflexible, as it is not usable with air curable coatings and necessitates the use of a relatively expensive piece of on-line equipment to provide the inert atmosphere.

It is thus an object of the invention to provide a method and apparatus for producing radiation-cured coatings having low gloss.

It is a further object of the invention to provide a method and apparatus for producing radiation-cured coatings having controlled gloss.

It is still a further object of the invention to provide a method and apparatus which allows efficient and flexible on-line control of the degree of gloss obtained.

It is still a further object to provide a method and apparatus for producing low gloss coatings which is usable with air curable coating compositions and which does not require the use of additional apparatus for providing an inert atmosphere.

The above objects are accomplished by providing a radiation-curable coating of a composition which includes inert particulates. The coating is first irradiated with curing radiation of wavelengths to which the coating is responsive but having substantially no distribution beneath about 300 nm, and is subsequently irradiated with curing radiation of wavelengths to which the coating is responsive including substantial radiation at wavelengths beneath 300 nm.

Gloss control is conveniently and flexibly obtained by adjusting on-line parameters including the spectral distribution, the intensity, or the dose of the initial radiation, or the time interval between the initial and subsequent irradiation steps. Further, these line parameters may be adjusted to compensate for batch to batch variations in coating compositions and for variations in the coating process, to provide a high order of quality control frequently not afforded in prior art approaches.

The coatings obtained with the process of the invention exhibit significantly lower gloss than when the same coating compositions are cured by conventional methods. Other properties of the coating such as strength, abrasion resistance, and stain resistance are not adversely affected.

The invention will be better understood by referring to the accompanying drawings in which.

Figure 1:
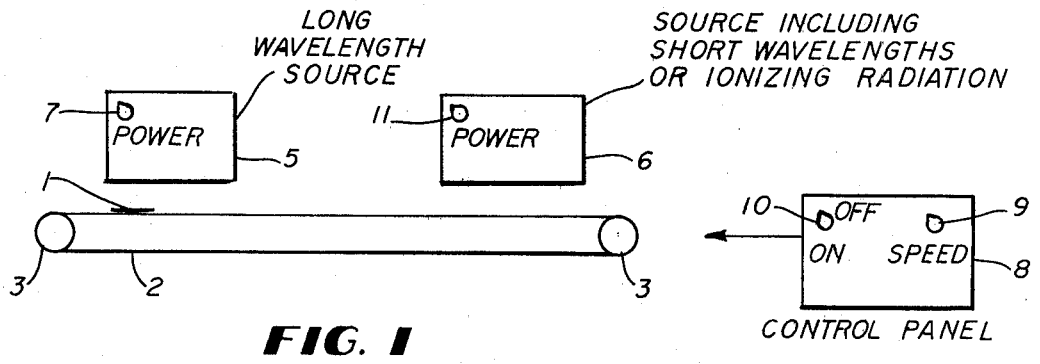
FIG. 1 is a pictorial illustration of an apparatus incorporating a first embodiment of the invention.

Referring to FIG. 1, article 1, which is coated with an ultraviolet-curable coating to be cured is moved along a process line by conventional conveying means, which is illustratively depicted in the Figure as the conveyor comprised of belt 2 and rollers 3. The conventional prior art technique for curing such a coating is to irradiate it with a single dose of ultraviolet radiation having spectral output across the entire ultraviolet range (200–400 nm), such as is produced by a mercury lamp. As mentioned above, this procedure results in a relatively glossy coating, which can be made somewhat flatter if the chemical composition of the coating is arranged to include flatting agents or inert particulates.

The present invention is based on the discovery that a substantial reduction in gloss can be achieved, especially for coatings of ½ mil or thicker, if the same coating containing inert particulates is first irradiated with radiation to which the coating is responsive but having no or minimal spectral output beneath about 300 nm and in a separate step is subsequently irradiated with radiation of wavelengths to which the coating is responsive and having substantial spectral output in the range beneath 300 nm. This process is illustrated in FIG. 1 wherein the coating on article 1 is first irradiated by relatively long wavelength source 5 which is substantially cut off beneath about 300 nm and is subsequently irradiated by source 6 which includes substantial power output in the range beneath 300 nm.

The initial irradiation may include spectral components above the ultraviolet range, such as in the visible range (400–450 nm). The curing radiation in the subsequent curing step may also include visible radiation as well as radiation beneath the ultraviolet range, such as ionizing radiation of various types, including particulate radiation. It should be understood that there is an interaction between the spectrum of curing radiation and the specific coating composition utilized, so that the precise spectrum and types of radiation used to achieve a desired gloss level may be varied to a certain extent depending on the chemical composition of the coating.

In an illustrative embodiment, light source 5 is comprised of a Fusion Systems ultraviolet lamp using a type D bulb filtered with a pyrex filter which cuts off at approximately 300–310 nm, while light source 6 is a Fusion Systems ultraviolet lamp using a type H bulb. Both of these sources are available from Fusion Systems Co., Rockville, Maryland. It is emphasized that use of these particular sources is disclosed for purposes of illustration only, and that a wide variety of specific sources can be used as long as the spectral output conditions discussed above are fulfilled. As is known to those in the art, in general a desired spectrum may be obtained by appropriate selection of lamp fill, lamp wall material, external filter means, or a combination of these.

The resulting degree of gloss can be controlled online by varying one or more of certain line parameters. More specifically, it has been found that control can be exercised by adjusting either the spectral distribution, the intensity, or the dose of the radiation in the initial cure step, or by varying the time interval between the initial and subsequent cure steps.

Thus, changing the spectral distribution at longer wavelengths over 300 nm tends to change the gloss obtained, and increasing the intensity and/or the dose of the initial exposure tends to reduce the gloss obtained. Increasing the time interval between the initial and subsequent exposure steps has also been found to reduce the gloss. It is to be understood that all of these effects are limited to certain operable ranges, beyond which an increase in a given parameter will not necessarily reduce the gloss, and may even increase it.

The intensity of the initial exposure may be controlled either by increasing the output power of the source, for example by adjusting the power control 7 in FIG. 1, or by changing the distance between the source and the coating to be cured. The dose may be controlled by varying the number of rows of lamps used or by adjusting line speed. For instance, control panel 8 for effecting overall control of the process line might include a speed control 9, as well as the on/off switch 10 which is depicted in the Figure. Similarly, the interval between the initial and subsequent exposures can be controlled by adjustment of the line speed, and if desired separate conveyors running at different speeds may be used in conjunction with the respective cure steps or a separate conveyor may be used between the steps. If the coating on a continuous web of material is being cured, then a height-adjustable accumulator roll located between the sites where the two curing steps are performed may be used to change the path length and therefore the time interval therebetween. Of course, control of the parameters such as source intensity, line speed, and time interval between exposures, can be programmed into the system in accordance with state of the art programming techniques to effect automatic parameter adjustments in accordance with predetermined criteria.

It is significant to recognize that adjustment of the gloss control parameters can be made easily and conveniently in accordance with the present invention without having to interrupt or disturb the process line. This is in distinction to the prior art method which relies solely on the makeup of the coating composition to control gloss wherein control cannot be as precise as herein, and wherein interruption of the line may be necessary. Further, with the approach of the present invention, control can be exercised more conveniently and flexibly than when the curing must take place in an inert atmosphere.

Figure 2:
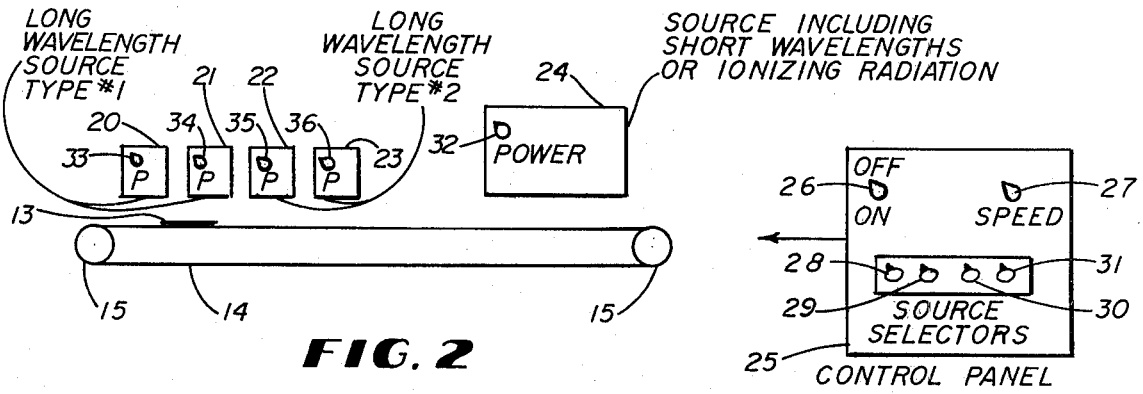
FIG. 2 is a pictorial illustration of an apparatus incorporating a further embodiment of the invention.

The embodiment of FIG. 2 illustrates one way in which the spectral distribution above 300 nm of the initial exposure step can be used to control gloss. Referring to that Figure, sources 20 and 21 each comprise long wavelength ultraviolet type #1 while sources 22 and 23 each comprise long wavelength ultraviolet source type #2, the difference in the two sources being that the spectral density of type #2 is more concentrated in the higher wavelength region near 400 nm. If source type #1 and #2 were located on separate process lines respectively, because of their different spectral distributions, their use would result in coatings having different gloss levels. In the embodiment of FIG. 2, source types #'s 1 and 2 may be selected and/or combined to control the degree of gloss obtained. Source 24 used for the second cure step may be similar to the source used for this step in the embodiment of FIG. 1.

Control panel 25 besides including on/off switch 26 and speed control 27, discussed in connection with FIG. 1, also includes source selector switches 28–31 which are used to turn sources 20–23 respectively, on or off. By selecting desired combinations of individual sources, the spectral distribution of the initial cure step and therefore the resulting gloss may be adjusted.

Of course, more or fewer than four rows of sources may be used in the embodiment of FIG. 2, and the multiple source control concept is applicable to other parameters besides lamp bulb spectral characteristics. For instance, a plurality of rows of identical lamps may be employed with selective filtering to control gloss, or the magnitude of the power output of the lamps in the different rows may be selectively controlled.

Figure 3:
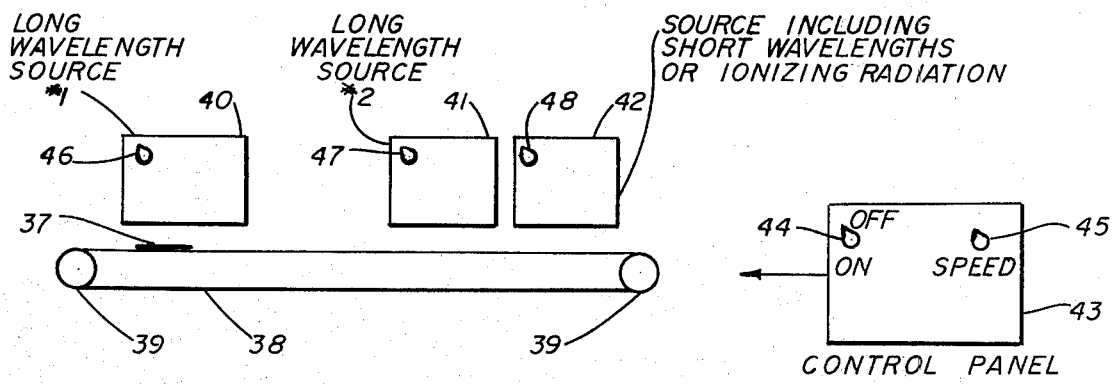
FIG. 3 is a pictorial illustration of an apparatus incorporating still a further embodiment of the invention.

It should be noted that while there are two essential cure steps in the method of the invention, configurations where more than two exposures are used are possible. For example, there may be intermediate cure steps or post cure steps of specific types. Such an embodiment is illustrated in FIG. 3 wherein long wavelength source 40 for effecting the initial cure step is similar to the source 5 described in conjunction with FIG. 1. After a certain time interval, the coating is irradiated by a different long wavelength source 41 which may have the same or a different spectral output above 300 nm than source 40, and the same or a different power output level. After source 41, the coating is irradiated by source 42 which may be similar to source 6 of FIG. 1. Other types of intermediate or post curing steps may be possible and are intended to be within the scope of the invention.

The invention is illustrated in examples which follow:

EXAMPLE 1

A vinyl asbestos tile substrate was coated with a flatted UV curable acrylourethane coating (W. R. Grace & Co. F903) with a wire wound rod. The coating had a dry film thickness of 4 mils.

The coated substrate was subjected to ultraviolet light radiation by passing under 2 rows of mercury vapor lamps (Fusion Systems Corporation Type H) at a speed of 40 ft. per minute. The gloss of the resulting coated substrate measured as percent reflectance at a 60° angle was 67%.

A similarly coated substrate was subjected first to ultraviolet light passing under a Fusion Systems type D bulb filtered with a glass filter that absorbs irradiation at wavelengths below 310 nanometers at a speed of 40 ft. per minute. The coated substrate was immediately thereafter subjected to additional ultraviolet radiation by passing under 2 rows of mercury vapor type H lamps at a speed of 40 ft. per minute. The gloss of the resulting coated substrate was 28%.

EXAMPLE 2

A vinyl asbestos tile substrate was coated with a flatted UV curable acrylourethane coating (Hughson Chemicals TS1525-73) with a wire wound rod. The coating had a dry film thickness of 4 mils.

The coated substrate was subjected to ultraviolet light radiation by passing under 2 rows of mercury vapor lamps (Fusion System Corporation type H) at a speed of 30 ft. per minute. The gloss of the resulting coated substrate was 68%.

A similarly coated substrate was subjected first to ultraviolet light by passing under a Fusion Systems type CG bulb, which emits essentially no wavelengths below 300 nanometers, at a speed of 30 ft. per minute. Twenty seconds thereafter the coated substrate was subjected to additional ultraviolet radiation by passing under 2 rows of type H mercury vapor lamps at a speed of 30 ft. per minute. The gloss of the resulting coated substrate was 47%.

A third similarly coated substrate was subject to the same ultraviolet radiation sequence described above; however, a time interval of 30 seconds elapsed between the first and second irradiation steps. The gloss of the resulting coated substrate was 38%.

While it conceivably may be possible to obtain a fully cured coating having low gloss after only the first exposure step of the present invention has been performed, as a practical matter the surface of the coating is usually wet after only the first cure step and the second step is necessary to obtain full cure.

Further, to obtain the benefits of the invention the coating composition must include flatting agents or inert particulates, as if a coating without such constituents is cured by the steps of the invention it is believed that no significant reduction in gloss will be obtained.

There thus has been disclosed both a method and apparatus for achieving gloss reduction in radiation-cured coatings and for controlling the level of such gloss. While we have described and illustrated certain embodiments of our invention, we wish it to be understood that we do not intend to be restricted thereto, but rather intend to cover all variations, modifications and uses which come within the spirit of the invention, which is limited only by the claims appended hereto.

What is claimed is:

1. A method of producing either a relatively low gloss or a gloss controlled radiation-cured coating, comprising the steps of, providing a radiation curable coating of a composition which includes inert particulates, irradiating said coating with curing radiation of wavelengths to which the coating is responsive but having substantially no distribution beneath about 300 nm, and, subsequently irradiating said coating with curing radiation of wavelengths to which the coating is responsive including substantial radiation at wavelengths beneath 300 nm.

2. The method of claim 1 wherein said radiation-curable coating is at least one-half mil thick.

3. The method of claim 2 wherein said coating is an ultraviolet-curable coating and wherein the curing radiation of the first-recited curing step is distributed in at least part of the 300–450 nm range.

4. The method of claims 2 or 3 wherein the curing radiation in said subsequent curing step also has components in at least part of the 300–450 nm range.

5. The method of claims 2 or 3 wherein the curing radiation in said subsequent curing step includes ionizing radiation.

6. The method of claim 2 wherein there is a time interval between the first-recited and subsequent curing steps.

7. The method of claim 6 further including an intermediate curing step which occurs between said first-recited and subsequent curing steps.

8. The method of claim 7 wherein said intermediate curing step comprises again irradiating said coating with curing radiation of wavelengths to which the coating is responsive but having substantially no distribution beneath about 300 nm.

9. The method of claim 6 wherein the degree of gloss of said radiation-cured coating is controlled by adjusting said time interval.

10. The method of claim 3 wherein the degree of gloss of said radiation-cured coating is controlled by adjusting the spectral distribution of the curing radiation used in said first-recited curing step.

11. The method of claim 10 wherein said spectral distribution is adjusted with filtering means.

12. The method of claim 10 wherein said spectral distribution is adjusted by employing a plurality of source means having different spectral outputs and irradiating the coating with a selected one or combination of said source means.

13. The method of claim 12 wherein each source means comprises the combination of a lamp and a filter means.

14. The method of claim 3 wherein the degree of gloss of said radiation-cured coating is controlled by adjusting the intensity of the curing radiation used in said first-recited curing step.

15. The method of claim 14 wherein a source means emits said curing radiation and said intensity is adjusted by adjusting the power level of said source means.

16. The method of claim 15 wherein a plurality of source means in a row emits the curing radiation and said intensity is adjusted by selectively adjusting the power levels of individual source means.

17. The method of claim 14 wherein a source means emits said curing radiation and said intensity is adjusted by adjusting the distance between said source means and said coating.

18. The method of claim 3 wherein the degree of gloss of said radiation-cured coating is controlled by adjusting the dose of curing radiation used in said first-recited curing step.

19. The method of claim 18 wherein a plurality of rows of source means emits said curing radiation and said dose is controlled by adjusting the number of said rows.

20. The method of claim 18 wherein a source means emits said curing radiation and said coating is conveyed beneath said source means, and wherein said dose is controlled by adjusting the speed at which said coating is conveyed.

21. The method of claim 3 wherein the radiation for said first-recited step is provided by first light source means and for said subsequent step by second light source means, further including the step of conveying said coating beneath said first and second source means in that order.

* * * * *